US006854283B2

(12) United States Patent
Nakatani et al.

(10) Patent No.: US 6,854,283 B2
(45) Date of Patent: Feb. 15, 2005

(54) DETERMINING METHOD OF HIGH PRESSURE OF REFRIGERATION CYCLE APPARATUS

(75) Inventors: Kazuo Nakatani, Osaka (JP); Yoshikazu Kawabe, Shiga (JP); Noriho Okaza, Shiga (JP); Yuji Inoue, Shiga (JP); Akira Hiwata, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/658,421

(22) Filed: Sep. 10, 2003

(65) Prior Publication Data

US 2004/0118138 A1 Jun. 24, 2004

(30) Foreign Application Priority Data

Oct. 31, 2002 (JP) ..... 2002-318131

(51) Int. Cl.[7] ..... F28B 9/00

(52) U.S. Cl. ..... 62/172; 62/197; 62/401; 62/513

(58) Field of Search ..... 62/172, 401, 402, 62/197, 513, 113

(56) References Cited

U.S. PATENT DOCUMENTS

| | | | | |
|---|---|---|---|---|
| 5,515,694 A | * | 5/1996 | Meloling et al. | 62/197 |
| 5,943,877 A | * | 8/1999 | Chen | 62/402 |
| 6,321,564 B1 | | 11/2001 | Yamanaka et al. | 62/510 |
| 6,438,994 B1 | | 8/2002 | Rashad et al. | 62/613 |
| 6,595,024 B1 | * | 7/2003 | Tang et al. | 62/498 |
| 6,644,062 B1 | * | 11/2003 | Hays | 62/402 |
| 2003/0196452 A1 | * | 10/2003 | Wilding et al. | 62/613 |

FOREIGN PATENT DOCUMENTS

| | | |
|---|---|---|
| EP | 0 541 324 A1 | 5/1993 |
| JP | 2000-234814 | 8/2000 |
| JP | 2001-116371 | 4/2001 |
| JP | 2002-130770 | 5/2002 |
| JP | 2002-349977 | 12/2002 |
| JP | 2003-83620 | 3/2003 |

OTHER PUBLICATIONS

Huff et al.: " High–side–pressure optimization in TRA NSCritical $CO_2$ cycles with work–extracting expansion devices", SAE Automotive Alternate Refrigerant Systems Symposium, Jul. 2002, pp. 1–18.

Joo Seok Baek et al. : "High–side–pressure optimization in TRA NACritical $CO_2$ cycles with work–extracting expansion devices"; SAE Automotive Alternate Refrigerant Systems Symposium Jul. 2002, pp. 1–17.

European Search Report dated Mar. 8, 2004.

* cited by examiner

*Primary Examiner*—Marc Norman

(74) *Attorney, Agent, or Firm*—Armstrong, Kratz, Quintos, Hanson & Brooks, LLP

(57) ABSTRACT

It is an object of the present invention to reduce the constraint that the density ratio is constant as small as possible, and to obtain high power recovering effect in a wide operation range by using an expander which is operated in accordance with a flowing direction of refrigerant. A determining method of a high pressure of a refrigeration cycle apparatus in which a refrigeration cycle uses carbon dioxide as refrigerant and has a compressor, an outdoor heat exchanger, an expander and an indoor heat exchanger, and the refrigeration cycle including a bypass circuit provided in parallel to said expander, and a control valve which adjusts a flow rate of refrigerant flowing through said bypass circuit, said compressor being driven by power recover by said expander, wherein if an optimal high pressure of a first refrigeration cycle flowing through said expander and a second refrigeration cycle flowing through said bypass circuit is defined as Ph, and a bypass amount ratio flowing through said bypass circuit in said Ph is defined as Rb0, and a maximum refrigeration cycle efficiency of said first refrigeration cycle in said Ph is defined as COPe, and a maximum refrigeration cycle efficiency of said second refrigeration cycle in said Ph is defined as COPb, the optimal high pressure Ph which maximizes (1–Rb0)×COPe+Rb0×COPb is determined.

4 Claims, 6 Drawing Sheets

DETERMINING METHOD OF HIGH PRESSURE OF REFRIGERATION CYCLE APPARATUS

TECHNICAL FIELD

The present invention relates to a refrigeration cycle apparatus in which a refrigeration cycle uses carbon dioxide as refrigerant and has a compressor, an outdoor heat exchanger, an expander and an indoor heat exchanger, and the refrigeration cycle including a bypass circuit provided in parallel to the expander, and a control valve which adjusts a flow rate of refrigerant flowing through the bypass circuit, the compressor is driven by power recover by the expander.

BACKGROUND TECHNIQUE

A flow rate of refrigerant which circulates through a refrigeration cycle apparatus is all the same in any points in a refrigeration cycle. In a cycle in which a compressor and an expander coaxially rotate, if a suction density of refrigerant passing through a compressor is defined as DC and a suction density of refrigerant passing through an expander is defined as DE, the DE/DC (density ratio) is always constant.

In recent years, attention is focused on a refrigeration cycle apparatus using, as a refrigerant, carbon dioxide ($CO_2$, hereinafter) in which ozone destroy coefficient is zero and global warming coefficient is extremely smaller than Freon. The $CO_2$ refrigerant has a low critical temperature as low as 31.06° C. When a temperature higher than this temperature is utilized, a high pressure side (outlet of the compressor-gas-cooler-inlet of pressure reducing device) of the refrigeration cycle apparatus is brought into a supercritical state in which $CO_2$ refrigerant is not condensed, and there is a feature that operation efficiency of the refrigeration cycle apparatus is deteriorated as compared with a conventional refrigerant. Therefore, in the refrigeration cycle apparatus using $CO_2$ refrigerant, in order to maintain optimal COP, it is necessary to obtain an optimal refrigerant pressure in accordance with variation in a temperature of the refrigerant.

However, when the refrigeration cycle apparatus is provided with the expander and power recover by the expander is used as a portion of a driving force of the compressor, in the cycle in which the compressor and the expander coaxially rotate, the number of rotation of the expander and the number of rotation of the compressor must be the same, and it is difficult to maintain the optimal COP when the operation condition is changed under constraint that the density ratio is constant.

Hence, there is proposed a structure in which a bypass pipe which bypasses the expander is provided, the refrigerant amount flowing into the expander is controlled, and the optimal COP is maintained (see patent documents 1 and 2 for example)

[Patent Document 1]

Japanese Patent Application Laid-open No.2000-234814 (paragraphs (0024) and (0025) and FIG. 1)

[Patent Document 2]

Japanese Patent Application Laid-open No.2001-116371 (paragraph (0023) and FIG. 1)

The patent document 1 describes that a bypass amount is increased when a pressure of a high pressure side is equal to or higher than a predetermined pressure, and the bypass amount is reduced when the pressure of the high pressure side is less than the predetermined pressure. However, a concrete determining method of the predetermined pressure for adjusting the bypass amount is not described.

Hence, it is an object of the present invention to provide a method for concretely determining this bypass amount when the apparatus includes a bypass circuit which bypasses the expander.

SUMMARY OF THE INVENTION

A first aspect of the present invention provides a determining method of a high pressure of a refrigeration cycle apparatus in which a refrigeration cycle uses carbon dioxide as refrigerant and has a compressor, an outdoor heat exchanger, an expander and an indoor heat exchanger, and the refrigeration cycle including a bypass circuit provided in parallel to the expander, and a control valve which adjusts a flow rate of refrigerant flowing through the bypass circuit, the compressor being driven by power recover by the expander, wherein if an optimal high pressure of a first refrigeration cycle flowing through the expander and a second refrigeration cycle flowing through the bypass circuit is defined as Ph, and a bypass amount ratio flowing through the bypass circuit in the Ph is defined as Rb0, and a maximum refrigeration cycle efficiency of the first refrigeration cycle in the Ph is defined as COPe, and a maximum refrigeration cycle efficiency of the second refrigeration cycle in the Ph is defined as COPb, the optimal high pressure Ph which maximizes $(1-Rb\mathbf{0})\times COPe+Rb\mathbf{0}\times COPb$ is determined.

According to this aspect, by determining the optimal high pressure Ph in which $(1-Rb\mathbf{0})\times COPe+Rb\mathbf{0}\times COPb$ becomes maximum, it is possible to concretely determine the optimal predetermined pressure in a refrigeration cycle apparatus having a bypass circuit which bypasses the expander.

According to a control method of a refrigeration cycle apparatus of a second aspect, the control valve is controlled such that a high pressure determined by the determining method of the high pressure of the refrigeration cycle apparatus according to the first aspect is obtained.

According to this aspect, in a refrigeration cycle apparatus having a bypass circuit which bypasses the expander, it is possible to operate the apparatus at the optimal high pressure, and the COP can be made maximum. It is possible to prevent the high pressure from rising and to enhance the reliability of the compressor.

A third aspect of the invention provides a refrigeration cycle apparatus in which a refrigeration cycle uses carbon dioxide as refrigerant and has a compressor, an outdoor heat exchanger, an expander and an indoor heat exchanger, and the refrigeration cycle including a bypass circuit provided in parallel to the expander, and a control valve which adjusts a flow rate of refrigerant flowing through the bypass circuit, the compressor being driven by power recover by the expander, wherein the refrigeration cycle apparatus comprises an internal heat exchanger which exchanges heat of high pressure refrigerant flowing through the bypass circuit and heat of low pressure refrigerant before the low pressure refrigerant is suctioned by the compressor.

A fourth aspect of the invention provides a refrigeration cycle apparatus in which a refrigeration cycle uses carbon dioxide as refrigerant and has a compressor, an outdoor heat exchanger, an expander, an indoor heat exchanger and an auxiliary compressor, and the refrigeration cycle including a bypass circuit provided in parallel to the expander, and a control valve which adjusts a flow rate of refrigerant flowing through the bypass circuit, the auxiliary compressor being driven by power recover by the expander, wherein the refrigeration cycle apparatus comprises an internal heat exchanger which exchanges heat of high pressure refrigerant flowing through the bypass circuit and heat of low pressure refrigerant before the low pressure refrigerant is suctioned by the compressor.

According to these aspects, an enthalpy of a control valve inlet is reduced, the refrigeration capacity is increased, and the COP is enhanced.

A determining method of a high pressure of a refrigeration cycle apparatus of a fifth aspect of the invention, in the refrigeration cycle apparatus of the third or fourth aspect, if an optimal high pressure of a first refrigeration cycle flowing through the expander and a second refrigeration cycle flowing through the bypass circuit is defined as Ph, and a bypass amount ratio flowing through the bypass circuit in the Ph is defined as Rb0, and a maximum refrigeration cycle efficiency of the first refrigeration cycle in the Ph is defined as COPe, and a maximum refrigeration cycle efficiency of the second refrigeration cycle in the Ph is defined as COPb, the optimal high pressure Ph which maximizes (1−Rb0)×COPe+Rb0×COPb is determined.

In a refrigeration cycle apparatus having a bypass circuit which bypasses the expander, it is possible to concretely determine the optimal predetermined pressure.

In a control method of a refrigeration cycle apparatus of a sixth aspect of the invention, the control valve is controlled such that a high pressure determined by the determining method of the high pressure of the refrigeration cycle apparatus according to the fifth aspect is obtained.

Since the apparatus can be operated under the optimal high pressure, the COP can be made maximum. It is possible to prevent the high pressure from rising and to enhance the reliability of the compressor.

PREFERRED EMBODIMENTS

Figure 1:
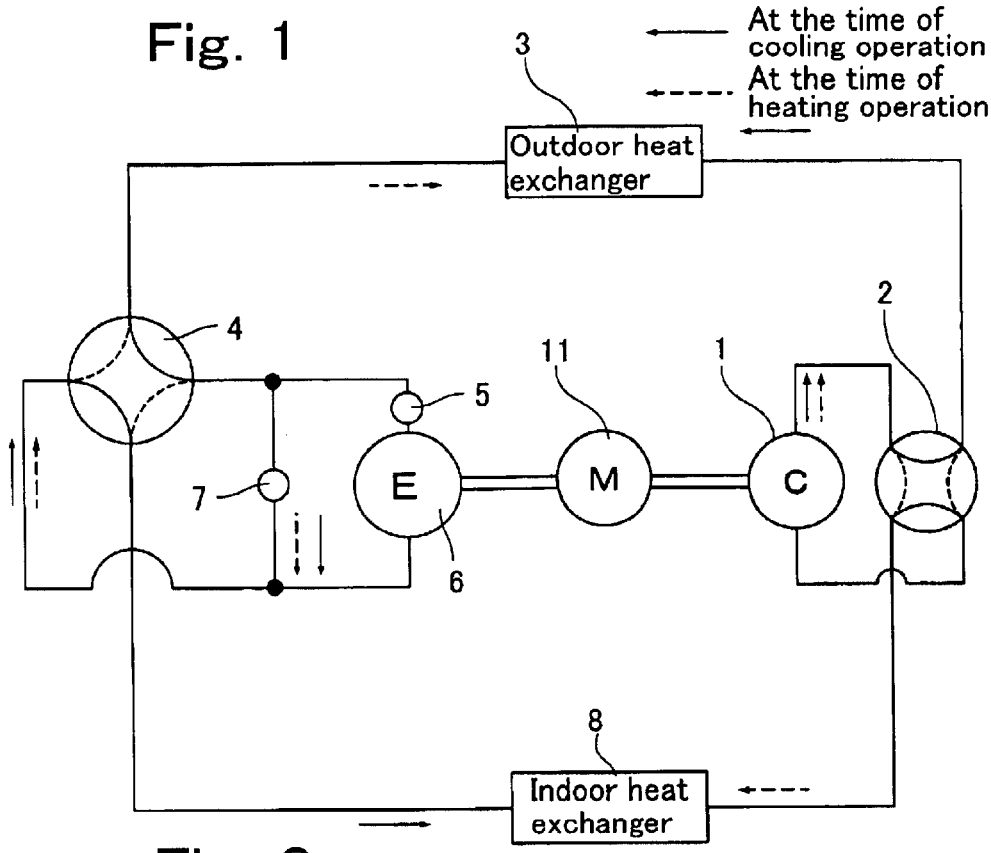
FIG. 1 shows a structure of a heat pump type cooling and heating air conditioner according to an embodiment of the present invention.

A refrigeration cycle apparatus according to an embodiment of the present invention will be explained with reference to the drawing below based on a heat pump type cooling and heating air conditioner.

FIG. 1 shows a structure of the heat pump type cooling and heating air conditioner of the present embodiment.

As shown in FIG. 1, the heat pump type cooling and heating air conditioner of this embodiment uses $CO_2$ refrigerant as refrigerant, and has a refrigerant circuit. The refrigerant circuit comprises a compressor 1 having a motor 11, an outdoor heat exchanger 3, an expander 6, and an indoor heat exchanger 8 which are all connected to one another through pipes.

The expander 6 is provided at its inflow side with a pre-expansion valve 5.

A bypass circuit which bypasses the pre-expansion valve 5 and the expander 6 is provided in parallel to the pre-expansion valve 5 and the expander 6. The bypass circuit is provided with a control valve 7.

A drive shaft of the expander 6 and a drive shaft of the compressor 1 are connected to each other, and the compressor 1 utilizes power recover by the expander 6 for driving.

The refrigerant circuit includes a first four-way valve 2 to which a discharge side pipe and a suction side pipe of the compressor 1 are connected, and a second four-way valve 4 to which a suction side pipe of the pre-expansion valve 5, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 11. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5 and the expander 6 and is expanded by the pre-expansion valve 5 and the expander 6. Power recover by the expander 6 at the time of expanding operation is used for driving the compressor 1. At that time, an opening of the control valve 7 is adjusted and an amount of refrigerant which is allowed to flow into the bypass circuit is controlled in accordance with a high pressure detected on the side of the outlet of the outdoor heat exchanger 3.

The $CO_2$ refrigerant expanded by the pre-expansion valve 5 and the expander 6 is introduced into the indoor heat exchanger 8 through the second four-way valve 4 and is evaporated and suctions heat in the indoor heat exchanger 8. A room is cooled by this endotherm The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the compressor 1. At that time, the opening of the control valve 7 is adjusted and the amount of refrigerant which is allowed to flow into the bypass circuit is controlled in accordance with a high pressure detected on the side of the outlet of the indoor heat exchanger 8.

The $CO_2$ refrigerant expanded by the pre-expansion valve 5 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

Next, a determining method of the high pressure for determining the opening of the control valve 7 and a control method of valve 7 at the time of the cooling and heating operation will be explained.

Figure 2:
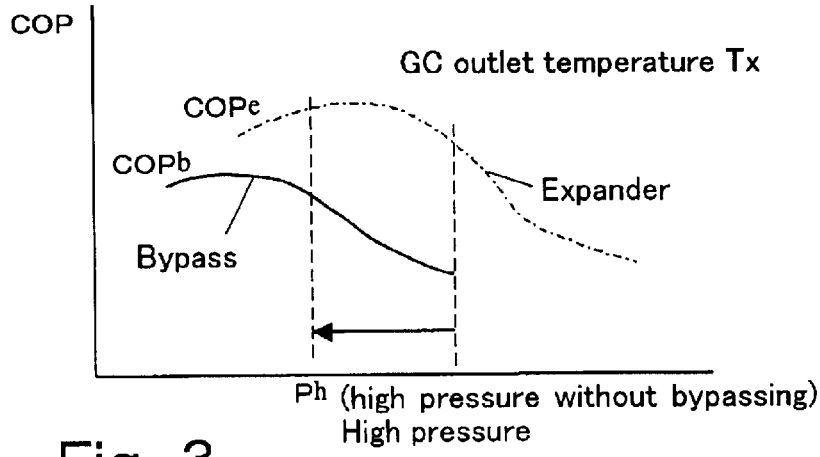
FIG. 2 shows characteristics showing a relation between a high pressure and a COP.

FIG. 2 shows characteristics showing a relation between a high pressure and the COP. The COP characteristics are separately shown in terms of a first refrigeration cycle flowing through the expander and a second refrigeration cycle flowing through the bypass circuit. In FIG. 2, a symbol COPe shows characteristics of the first refrigeration cycle flowing through the expander, and a symbol COPb shows characteristics of the second refrigeration cycle flowing through the bypass circuit.

In FIG. 2, a symbol Ph represents an optimal high pressure of the first refrigeration cycle flowing through the expander and the second refrigeration cycle flowing through the bypass circuit. This optimal high pressure Ph can be determined by the COPe of the first refrigeration cycle and the COPb of the second refrigeration cycle. However, it is necessary to take into account a ratio of a flow rate of refrigerant flowing through the first refrigeration cycle and a flow rate of refrigerant flowing through the second refrigeration cycle.

Figure 3:
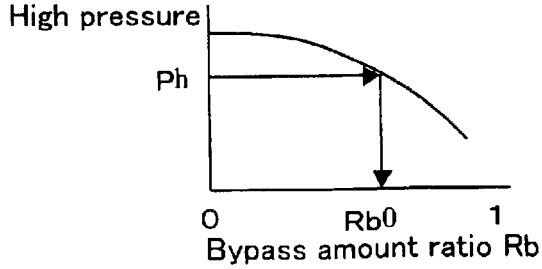
FIG. 3 shows characteristics showing a relation between a high pressure and a bypass amount ratio (a flow rate of refrigerant flowing through a bypass circuit with respect to a flow rate of refrigerant flowing through the entire refrigeration cycle apparatus).

FIG. 3 shows characteristics showing a relation between a high pressure and a bypass amount ratio (a flow rate of refrigerant flowing through the bypass circuit with respect to a flow rate of refrigerant flowing through the entire refrigeration cycle apparatus). As the flow rate of refrigerant flowing through the bypass circuit is increased, the high pressure is reduced, but if the optimal high pressure Ph is determined, the bypass amount ratio Rb0 corresponding to the optimal high pressure Ph is determined.

From the above relation, a bypass amount ratio Rb0 is determined by determining the optimal high pressure Ph which maximizes (1−Rb0)×COPe+Rb0×COPb. The opening of the control valve 7 is controlled such that the determined bypass amount ratio Rb0 is obtained.

As described above, according to this embodiment, it is possible to concretely determine the appropriate predetermined pressure, and the apparatus can be operated under the optimal high pressure, and the COP can be maximized. It is possible to prevent the high pressure from rising, and to enhance the reliability of the compressor.

A refrigeration cycle apparatus according to another embodiment of the present invention will be explained with reference to the drawing below based on a heat pump type cooling and heating air conditioner.

Figure 4:
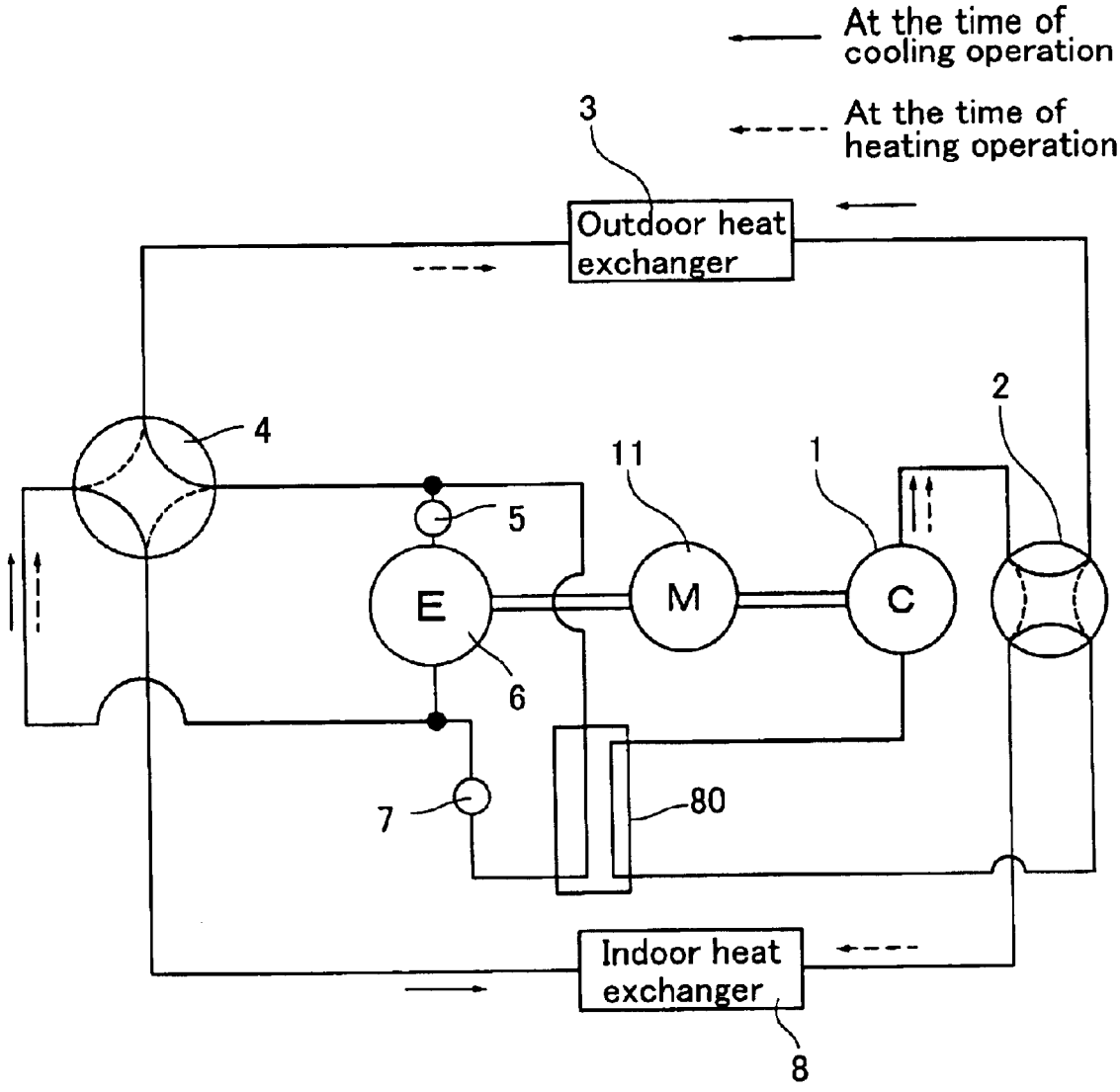
FIG. 4 shows a structure of a heat pump type cooling and heating air conditioner according to another embodiment of the invention.

FIG. 4 shows a structure of the heat pump type cooling and heating air conditioner of the present embodiment As shown in FIG. 4, the heat pump type cooling and heating air conditioner of this embodiment uses $CO_2$ refrigerant as refrigerant, and has a refrigerant circuit. The refrigerant circuit comprises a compressor 1 having a motor 11, an outdoor heat exchanger 3, an expander 6, and an indoor heat exchanger 8 which are all connected to one another through pipes.

The expander 6 is provided at its inflow side with a pre-expansion valve 5.

A bypass circuit which bypasses the pre-expansion valve 5 and the expander 6 is provided in parallel to the pre-expansion valve 5 and the expander 6. The bypass circuit is provided with a control valve 7.

An internal heat exchanger 80 exchanges heat of high pressure refrigerant flowing through the bypass circuit and heat of low pressure refrigerant before the low pressure refrigerant is suctioned by the compressor 1. The high pressure refrigerant flowing through the bypass circuit and the low pressure refrigerant before the low pressure refrigerant is suctioned by the compressor 1 flow in the opposite directions.

A drive shaft of the expander 6 and a drive shaft of the compressor 1 are connected to each other, and the compressor 1 utilizes power recover by the expander 6 for driving.

The refrigerant circuit includes a first four-way valve 2 to which a discharge side pipe and a suction side pipe of the compressor 1 are connected, and a second four-way valve 4 to which a suction pipe of the pre-expansion valve 5, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 11. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5 and the expander 6 and is expanded by the pre-expansion valve 5 and the expander 6. Power recover by the expander 6 at the time of expanding operation is used for driving the compressor 1. At that time, an opening of the control valve 7 is adjusted and an amount of refrigerant which is allowed to flow into the bypass circuit is controlled in accordance with a high pressure detected on the side of the outlet of the outdoor heat exchanger 3. As explained above, the opening of the control valve 7 is controlled such hat the bypass amount ratio Rb0 is determined by determining the optimal high pressure Ph which maximizes (1−Rb0)×COPe+Rb0×COPb, and such that the determined bypass amount ratio Rb0 is obtained.

The $CO_2$ refrigerant expanded by the pre-expansion valve 5 and the expander 6 is introduced into the indoor heat exchanger 8 through the second four-way valve 4 and is evaporated and suctions heat in the indoor heat exchanger 8.

A room is cooled by this endotherm. The refrigerant which has been evaporated is drawn into the compressor 1.

Heat of the high pressure refrigerant flowing through the bypass circuit is exchanged with heat of the low pressure refrigerant by the internal heat exchanger 80, then an enthalpy of the inlet of the control valve 7 is reduced, the refrigeration capacity is increased, and the COP is enhanced.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the compressor 1. At that time, the opening of the control valve 7 is adjusted and the amount of refrigerant which is allowed to flow into the bypass circuit is controlled in accordance with a high pressure detected on the side of the outlet of the indoor heat exchanger 8. As explained above, the opening of the control valve 7 is controlled such that the bypass amount ratio Rb0 is determined by determining the optimal high pressure Ph which maximizes (1−Rb0)×COPe+Rb0×COPb, and the determined bypass amount ratio Rb0 is obtained.

The $CO_2$ refrigerant expanded by the pre-expansion valve 5 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

Heat of the high pressure refrigerant flowing through the bypass circuit is exchanged with heat of the low pressure refrigerant by the internal heat exchanger 80, then an enthalpy of the inlet of the control valve 7 is reduced, the refrigeration capacity is increased, and the COP is enhanced.

The effect of this embodiment will be explained using FIGS. 7 and 8.

Figure 7:
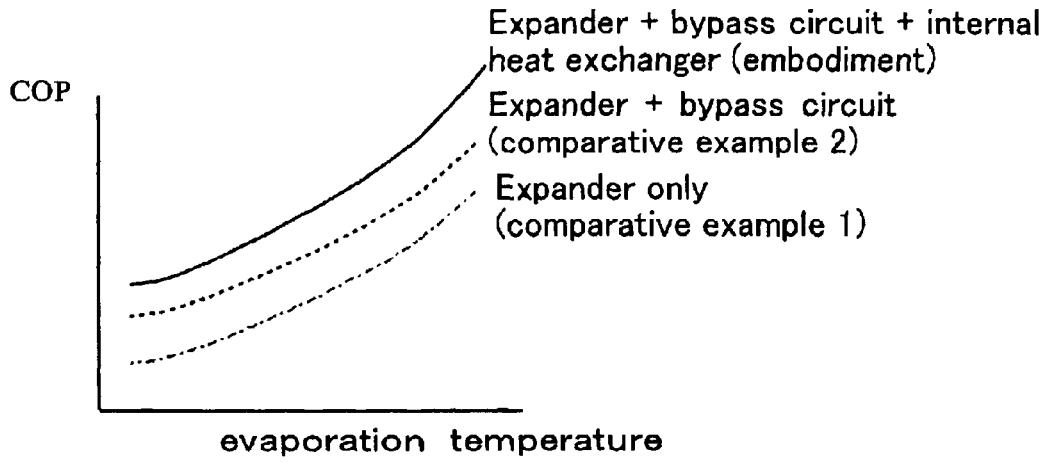
FIG. 7 shows characteristics showing a relation between an evaporation temperature and the COP.

FIG. 7 shows characteristics of a relation between an evaporation temperature and the COP, and shows this embodiment having the expander, the bypass circuit and the internal heat exchanger, a comparative example 1 having only the expander, and a comparative example 2 having the expander and the bypass circuit.

As shown in FIG. 7, in any of the evaporation temperatures, the comparative example 2 has higher COP than that of the comparative example 1, and this embodiment has higher COP than that of the comparative example 2.

Figure 8:
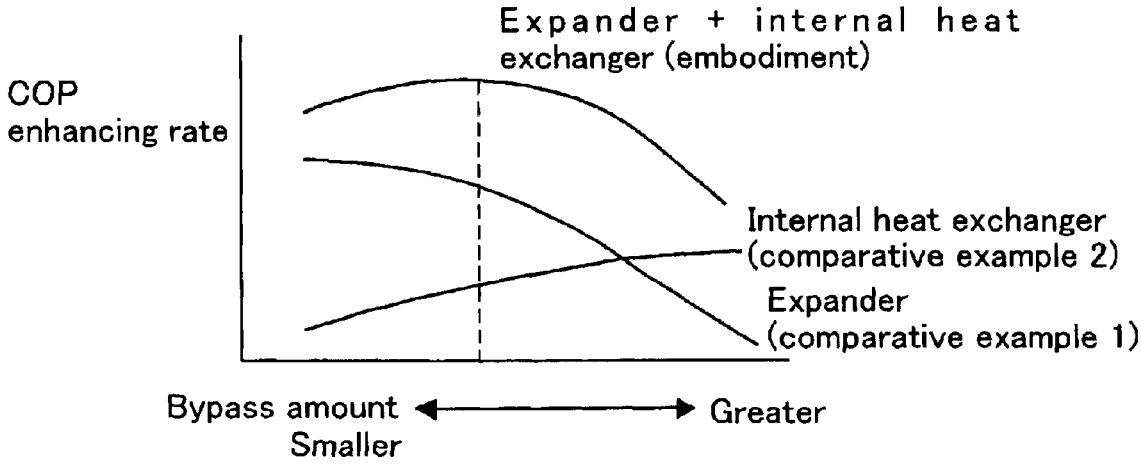
FIG. 8 shows characteristics showing an enhancing rate of the COP by variation of a bypass amount.

FIG. 8 shows characteristics showing an enhancing rate of the COP by variation of the bypass amount, and shows this embodiment having the expander and the internal heat exchanger, a comparative example 1 having the expander, and a comparative example 2 having the internal heat exchanger.

As shown in FIG. 8, in the case of the comparative example 1, the enhancing rate of the COP is reduced as the bypass amount is increased. In the case of the comparative example 2, the enhancing rate of the COP is increased as the bypass amount is increased. In the case of this embodiment, since the embodiment has both the effects of the comparative example 1 and comparative example 2, it is impossible to supress, by the effect of the internal heat exchanger, the reduction in the enhancing rate of COP in the expander when the bypass amount is increased.

Next, a determining method of the high pressure for determining the opening of the control valve 7 and a control method of the control valve 7 of this embodiment will be explained.

Figure 9:
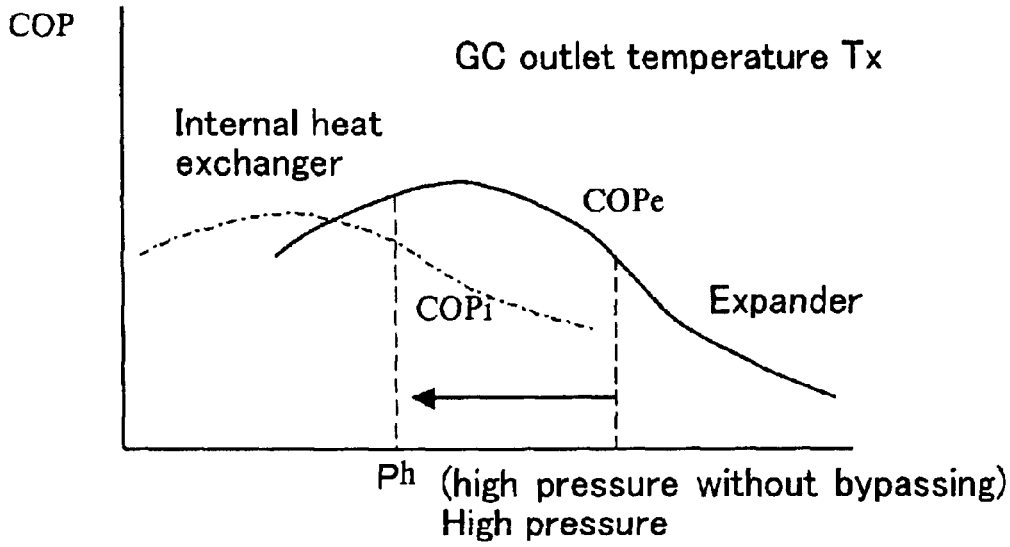
FIG. 9 shows characteristics showing a relation between the high pressure and the COP.

FIG. 9 shows characteristics showing a relation between a high pressure and the COP. The COP characteristics are separately shown in terms of a first refrigeration cycle flowing through the expander and a second refrigeration cycle flowing through the internal heat exchanger. In FIG. 9, a symbol COPe shows characteristics of the first refrigeration cycle flowing through the expander, and a symbol COPi shows characteristics of the second refrigeration cycle flowing through the internal heat exchanger.

In FIG. 9, a symbol Ph represents an optimal high pressure of the first refrigeration cycle flowing through the expander and the second refrigeration cycle flowing through the internal heat exchanger. This optimal high pressure Ph can be determined by the COPe of the first refrigeration cycle and the COPi of the second refrigeration cycle. However, it is necessary to take into account a ratio of a flow rate of refrigerant flowing through the first refrigeration cycle and a flow rate of refrigerant flowing through the second refrigeration cycle.

Figure 10:
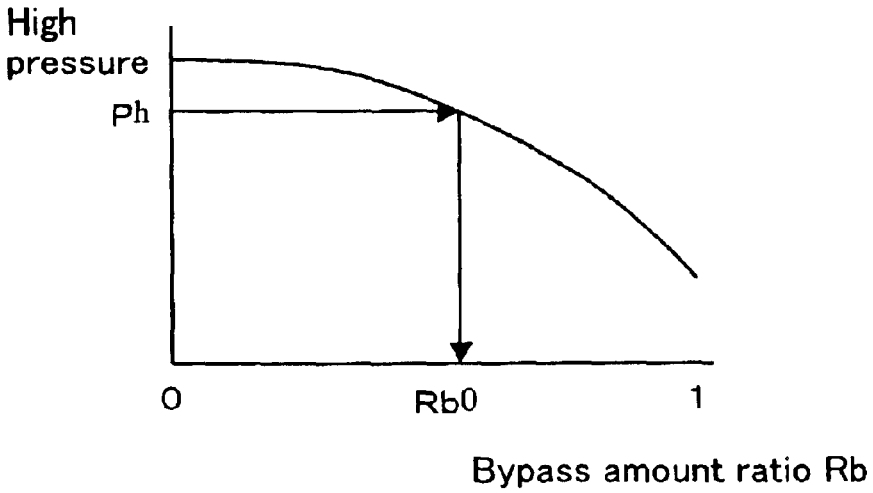
FIG. 10 shows characteristics showing a relation between a high pressure and a bypass amount ratio (a flow rate of refrigerant flowing through the internal heat exchanger with respect to a flow rate of refrigerant flowing through the entire refrigeration cycle apparatus).

FIG. 10 shows characteristics showing a relation between a high pressure and a bypass amount ratio (a flow rate of refrigerant flowing through the internal heat exchanger with respect to a flow rate of refrigerant flowing through the entire refrigeration cycle apparatus). As the flow rate of refrigerant flowing through the internal heat exchanger is increased, the high pressure is reduced, but if the optimal high pressure Ph is determined, the bypass amount ratio Rb0 corresponding to the optimal high pressure Ph is determined.

From the above relation, a bypass amount ratio Rb0 is determined by determining the optimal high pressure Ph which maximizes (1−Rb0)×COPe+Rb0×COPi. The opening of the control valve 7 is controlled such that the determined bypass amount ratio Rb0 is obtained.

As described above, according to this embodiment, it is possible to concretely determine the appropriate predetermined pressure, and the apparatus can be operated under the optimal high pressure, and the COP can be maximized. It is possible to prevent the high pressure from rising, and to enhance the reliability of the compressor.

A refrigeration cycle apparatus according to another embodiment of the present invention will be explained with reference to the drawing below based on a heat pump type cooling and heating air conditioner.

Figure 5:
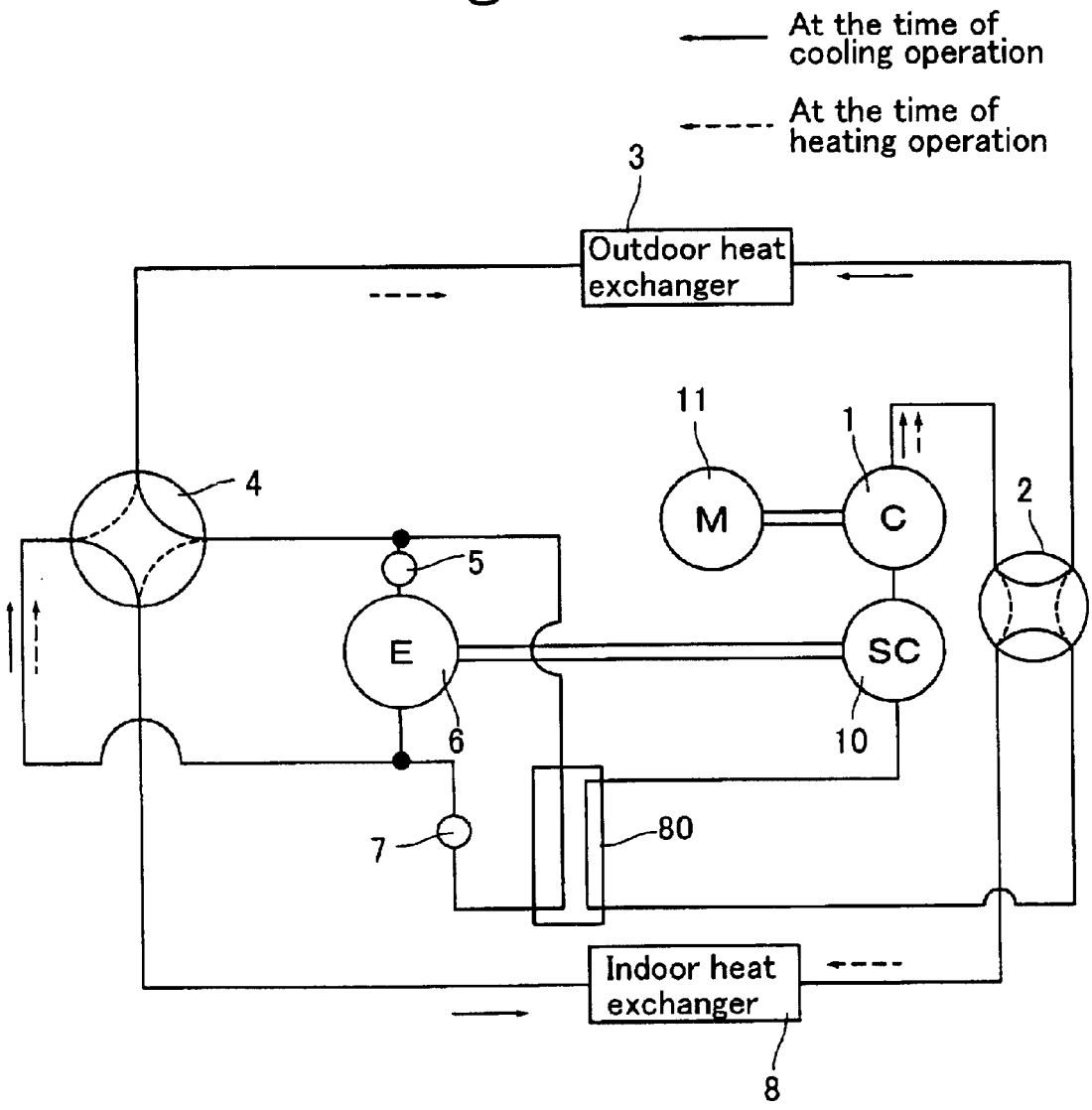
FIG. 5 shows a structure of a heat pump type cooling and heating air conditioner according to another embodiment of the invention.

FIG. 5 shows a structure of the heat pump type cooling and heating air conditioner of the present embodiment.

As shown in FIG. 5, the heat pump type cooling and heating air conditioner of this embodiment uses $CO_2$ refrigerant as refrigerant, and has a refrigerant circuit. The refrigerant circuit comprises a compressor 1 having a motor 11, an outdoor heat exchanger 3, an expander 6, an indoor heat exchanger 8 and an auxiliary compressor 10 which are all connected to one another through pipes.

The expander 6 is provided at its inflow side with a pre-expansion valve 5.

A bypass circuit which bypasses the pre-expansion valve 5 and the expander 6 is provided in parallel to the pre-expansion valve 5 and the expander 6. The bypass circuit is provided with a control valve 7.

An internal heat exchanger 80 exchanges heat of high pressure refrigerant flowing through the bypass circuit and heat of low pressure refrigerant before the low pressure refrigerant is suctioned by the auxiliary compressor 10. The high pressure refrigerant flowing through the bypass circuit and the low pressure refrigerant before the low pressure refrigerant is suctioned by the auxiliary compressor 10 flow in the opposite directions.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe of the compressor 1 and a suction side pipe of the auxiliary compressor 10 are connected, and a second four-way valve 4 to which a suction side pipe of the pre-expansion valve 5, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 11. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5 and the expander 6 and is expanded by the pre-expansion valve 5 and the expander 6. Power recover by the expander 6 at the time of expanding operation is used for driving the auxiliary compressor 10. At that time, an opening of the control valve 7 is adjusted and an amount of refrigerant which is allowed to flow into the bypass circuit is controlled in accordance with a high pressure detected on the side of the outlet of the outdoor heat exchanger 3. As explained above, the opening of the control valve 7 is controlled such that the bypass amount ratio Rb0 is determined by determining the optimal high pressure Ph which maximizes (1−Rb0)×COPe+Rb0×COPi, and such that the determined bypass amount ratio Rb0 is obtained.

The $CO_2$ refrigerant expanded by the pre-expansion valve 5 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is introduced into the auxiliary compressor 10 through the first four-way valve 2 and supercharged by the auxiliary compressor 10, and is drawn into the compressor 1.

Heat of the high pressure refrigerant flowing through the bypass circuit is exchanged with heat of the low pressure refrigerant by the internal heat exchanger 80, an enthalpy of the inlet of the control valve 7 is reduced, the refrigeration capacity is increased, and the COP is enhanced.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the auxiliary compressor 10. At that time, the opening of the control valve 7 is adjusted and the amount of refrigerant which is allowed to flow into the bypass circuit is controlled in accordance with a high pressure detected on the side of the outlet of the indoor heat exchanger 8. As explained above, the opening of the control valve 7 is controlled such that the bypass amount ratio Rb0 is determined by determining the optimal high pressure Ph which maximizes (1−Rb0)×COPe+Rb0×COPi, and such that the determined bypass amount ratio Rb0 is obtained.

The $CO_2$ refrigerant expanded by the pre-expansion valve 5 and the expander 6 is introduced into the outdoor heat exchanger 3 through the second four-way valve 4 and is evaporated and suctions heat in the outdoor heat exchanger 3. The refrigerant which has been evaporated is introduced into the auxiliary compressor 10 through the first four-way valve 2 and supercharged by the auxiliary compressor 10, and is drawn into the compressor 1.

Heat of the high pressure refrigerant flowing through the bypass circuit is exchanged with heat of the low pressure refrigerant by the internal heat exchanger 80, an enthalpy of the inlet of the control valve 7 is reduced, the refrigeration capacity is increased, and the COP is enhanced.

The effect of this embodiment is as shown in FIGS. 7 and 8.

Figure 6:
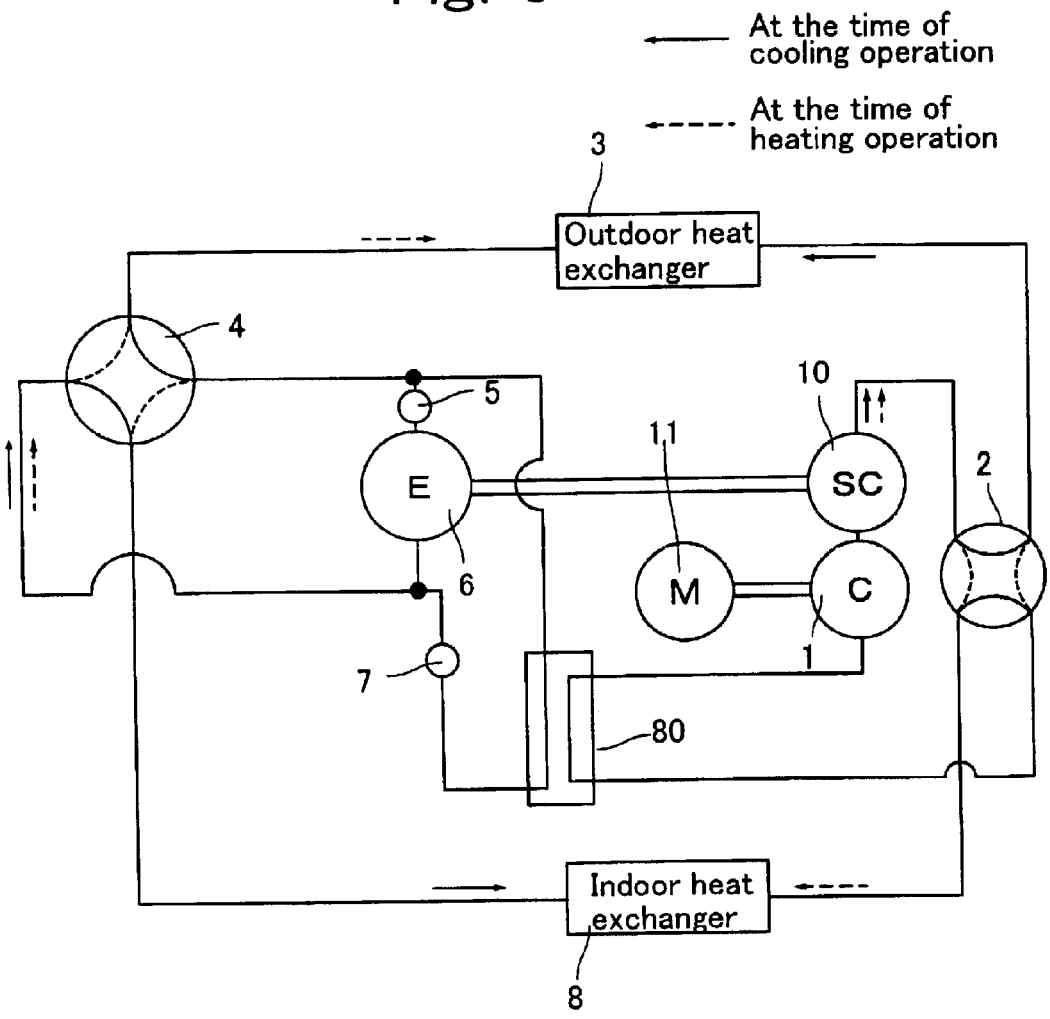
FIG. 6 shows a structure of a heat pump type cooling and heating air conditioner according to another embodiment of the invention.

FIG. 6 shows a structure of the heat pump type cooling and heating air conditioner of the present embodiment.

As shown in FIG. 6, the heat pump type cooling and heating air conditioner of this embodiment uses $CO_2$ refrigerant as refrigerant, and has a refrigerant circuit. The refrigerant circuit comprises a compressor 1 having a motor 11, an auxiliary compressor 10, an outdoor heat exchanger 3, an expander 6 and an indoor heat exchanger 8 which are all connected to one another through pipes.

The expander 6 is provided at its inflow side with a pre-expansion valve 5.

A bypass circuit which bypasses the pre-expansion valve 5 and the expander 6 is provided in parallel to the pre-expansion valve 5 and the expander 6. The bypass circuit is provided with a control valve 7.

An internal heat exchanger 80 exchanges heat of high pressure refrigerant flowing through the bypass circuit and heat of low pressure refrigerant before the low pressure refrigerant is suctioned by the compressor 1. The high pressure refrigerant flowing through the bypass circuit and the low pressure refrigerant before the low pressure refrigerant is suctioned by the compressor 1 flow in the opposite directions.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a suction side pipe of the compressor 1 and a discharge side pipe of the auxiliary compressor 10 are connected, and a second four-way valve 4 to which a suction side pipe of the pre-expansion valve 5, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 11. The refrigerant is introduced into the auxiliary compressor 10 and further super-pressurized by the auxiliary compressor 10 and then, is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5 and the expander 6 and is expanded by the pre-expansion valve 5 and the expander 6. Power recover by the expander 6 at the time of expanding operation is used for driving the auxiliary compressor 10. At that time, an opening of the control valve 7 is adjusted and an amount of refrigerant which is allowed to flow into the bypass circuit is controlled in accordance with a high pressure detected on the side of the outlet of the outdoor heat exchanger 3. As explained above, the opening of the control valve 7 is controlled such that the bypass amount ratio Rb0 is determined by determining the optimal high pressure Ph which maximizes (1−Rb0)×COPe+Rb0×COPi, and such that the determined bypass amount ratio Rb0 is obtained.

The $CO_2$ refrigerant expanded by the pre-expansion valve 5 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the compressor 1 through the first four-way valve 2.

Heat of the high pressure refrigerant flowing through the bypass circuit is exchanged with heat of the low pressure refrigerant by the internal heat exchanger 80, an enthalpy of the inlet of the control valve 7 is reduced, the refrigeration capacity is increased, and the COP is enhanced.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the auxiliary compressor 10 and further super-pressurized by the auxiliary compressor 10 and then, is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the auxiliary compressor 10. At that time, the opening of the control valve 7 is adjusted and the amount of refrigerant which is allowed to flow into the bypass circuit is controlled in accordance with a high pressure detected on the side of the outlet of the indoor heat exchanger 8. As explained above, the opening of the control valve 7 is controlled such that the bypass amount ratio Rb0 is determined by determining the optimal high pressure Ph which maximizes (1−Rb0)×COPe+Rb0×COPi, and such that the determined bypass amount ratio Rb0 is obtained.

The $CO_2$ refrigerant expanded by the pre-expansion valve 5 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

Heat of the high pressure refrigerant flowing through the bypass circuit is exchanged with heat of the low pressure refrigerant by the internal heat exchanger 80, an enthalpy of the inlet of the control valve 7 is reduced, the refrigeration capacity is increased, and the COP is enhanced.

The effect of this embodiment is as shown in FIGS. 7 and 8.

Although the above embodiments have been described using the heat pump type cooling and heating air conditioner, the present invention can also be applied to other refrigeration cycle apparatuses in which the outdoor heat exchanger 3 is used as a first heat exchanger, the indoor heat exchanger 8 is used as a second heat exchanger, and the first and second heat exchangers are utilized for hot and cool water devices or thermal storages.

The pre-expansion valve 5 which is explained in the embodiments may not be provided.

As described above, according to the present invention, in a refrigeration cycle apparatus having the bypass circuit which bypasses the expander, it is possible to operate the apparatus under the optimal high pressure, and to maximize the COP. It is possible to prevent the high pressure from rising, and to enhance the reliability of the compressor.

Further, according to the invention, there is provided the internal heat exchanger which exchanges heat of high pressure refrigerant flowing through the bypass circuit and heat of low pressure refrigerant before the low pressure refrigerant is suctioned by the compressor. Therefore, an enthalpy of the control valve inlet is reduced, the refrigeration capacity is increased, and the COP is enhanced.

What is claimed is:

1. A refrigeration cycle apparatus in which a refrigeration cycle uses carbon dioxide as refrigerant and has a compressor, an outdoor heat exchanger, an expander and an indoor heat exchanger, and the refrigeration cycle including a bypass circuit provided in parallel to said expander, and a control valve which adjusts a flow rate of refrigerant flowing through said bypass circuit, said compressor being driven by power recover by said expander, wherein said refrigeration cycle apparatus comprises an internal heat exchanger which exchanges heat of high pressure refrigerant flowing through said bypass circuit and heat of low pressure refrigerant before the low pressure refrigerant is suctioned by said compressor.

2. A refrigeration cycle apparatus in which a refrigeration cycle uses carbon dioxide as refrigerant and has a compressor, an outdoor heat exchanger, an expander, an indoor heat exchanger and an auxiliary compressor, and the refrigeration cycle including a bypass circuit provided in parallel to said expander, and a control valve which adjusts a flow rate of refrigerant flowing through said bypass circuit, said auxiliary compressor being driven by power recover by said expander, wherein said refrigeration cycle apparatus comprises an internal heat exchanger which exchanges heat of high pressure refrigerant flowing through said bypass circuit and heat of low pressure refrigerant before the low pressure refrigerant is suctioned by said compressor.

3. A determining method of a high pressure of a refrigeration cycle apparatus, said refrigeration cycle apparatus being described in claim 1 or 2, wherein if an optimal high pressure of a first refrigeration cycle flowing through said expander and a second refrigeration cycle flowing through said bypass circuit is defined as Ph, and a bypass amount ratio flowing through said bypass circuit in said Ph is defined as Rb0, and a maximum refrigeration cycle efficiency of said first refrigeration cycle in said Ph is defined as COPe, and a maximum refrigeration cycle efficiency of said second refrigeration cycle in said Ph is defined as COPb, the optimal high pressure Ph which maximizes $(1-Rb0)\times COPe+Rb0\times COPb$ is determined.

4. A control method of a refrigeration cycle apparatus wherein said control valve is controlled such that a high pressure determined by the determining method of the high pressure of the refrigeration cycle apparatus according to claim 3 is obtained.

* * * * *